US005921469A

United States Patent [19]

Romann

[11] Patent Number: 5,921,469

[45] Date of Patent: Jul. 13, 1999

[54] ELECTROMAGNETICALLY ACTUABLE FUEL INJECTION VALVE

[75] Inventor: Peter Romann, Stuttgart, Germany

[73] Assignee: Robert Bosch GmbH, Stuttgart, Germany

[21] Appl. No.: 08/397,163

[22] PCT Filed: Aug. 20, 1993

[86] PCT No.: PCT/DE93/00760

§ 371 Date: Mar. 6, 1995

§ 102(e) Date: Mar. 6, 1995

[87] PCT Pub. No.: WO94/05907

PCT Pub. Date: Mar. 17, 1994

[30] Foreign Application Priority Data

Sep. 5, 1992 [DE] Germany ..... 42 29 730

[51] Int. Cl.[6] ..... F02M 51/00

[52] U.S. Cl. ..... 239/397.5; 239/585.4; 239/900

[58] Field of Search ..... 239/585.1–585.5, 239/397.5, 900

[56] References Cited

U.S. PATENT DOCUMENTS

| | | | |
|---|---|---|---|
| 3,604,632 | 9/1971 | Eichelman | 239/600 X |
| 4,116,389 | 9/1978 | Furtah | 239/585.3 X |
| 4,152,903 | 5/1979 | Longsworth | 62/222 |
| 4,158,442 | 6/1979 | Rathmayr | 239/88 |
| 4,284,263 | 8/1981 | Newcomb | 251/129 |
| 4,483,485 | 11/1984 | Kamiya | 239/585.4 |
| 4,798,329 | 1/1989 | Mesenich | 239/5 |
| 5,156,341 | 10/1992 | Terakado et al. | 239/585.4 |
| 5,405,085 | 4/1995 | White | 239/79 X |

FOREIGN PATENT DOCUMENTS

| | | | |
|---|---|---|---|
| 3318486 | 2/1984 | Germany | 239/585.4 |

*Primary Examiner*—Kevin Weldon
*Attorney, Agent, or Firm*—Kenyon & Kenyon

[57] ABSTRACT

An injection valve can compensate for the reduction in through-flow experienced with known valves operating at higher temperatures. By forming the valve needle and valve seat carrier from different materials and more particularly by using a material with a very low coefficient of thermal expansion for the valve needle, the valve needle expands less in comparison with the valve seat carrier when there is an increase in temperature. Thus, an increase in travel occurs and a reduction in the metered quantity of fuel due to the formation of gas bubbles is avoided. The injection valve is particularly suitable for use in fuel injection systems of mixture-compressing, spark-ignition internal combustion engines.

1 Claim, 2 Drawing Sheets

ELECTROMAGNETICALLY ACTUABLE FUEL INJECTION VALVE

FIELD OF THE INVENTION

The present invention relates to an electromagnetically actuated valve, particularly to a fuel injection valve.

BACKGROUND INFORMATION

German Published Patent Application No. 38 31 196 A1 describes an electromagnetically actuated injection valve for fuel injection systems of mixture-compressing, spark-ignition internal combustion engines, in which injection valve a valve seat carrier and a valve needle are produced from the same material, for example chrome steel.

As the temperature of the fuel and of the interior of the internal combustion engine rises, the valve components, including the valve seat carrier and valve needle, assume an approximately equally high temperature. Since the valve seat carrier and the valve needle are produced from the same material, both valve components also have similar coefficients of thermal expansion; for example, the value $\alpha$ for chrome steel is approximately $16\times10^{-6}$ $K^{-1}$. As a result, during heating of the valve the longitudinal changes of the valve seat carrier and of the valve needle are similar. Consequently, the travel of the valve needle remains largely constant when temperature fluctuations occur in the internal combustion engine. When the valve is heated, a two-phase flow consisting of fuel and bubbles of gas is formed in the interior of the valve. This two-phase flow is disadvantageous to the extent that a reduction of the metered fuel inevitably occurs and thus a so-called leaning of the fuel/air mixture fed to the internal combustion engine occurs. A temperature increase in the interior of the internal combustion engine therefore has the consequence that when the same materials with identical coefficients of thermal expansion are used for the valve seat carrier and valve needle in the injection valve a reduction of the quantity of fuel delivered takes place.

SUMMARY OF THE INVENTION

In contrast to known valves, the electromagnetically actuated valve of the present invention has the advantage that by means of a suitable selection of material the reduction in through-flow of the metered fuel as a result of the formation of gas bubbles in the hot fuel is reduced and partially compensated. For the valve needle, it is expedient to use a material with a very low coefficient of thermal expansion, for example invar steel. The material invar steel is characterized by its nickel content of 36% and has the extremely small coefficient of thermal expansion $\alpha=0.9 \ldots 1.5\times10^{-6}$ $K^{-1}$. When the temperature of the injection valve increases, the valve needle consisting of invar steel expands less as a result of the small coefficient of thermal expansion in comparison with the valve seat carrier consisting of chrome steel. Thus, in the case of heating by means of this material pairing, an increase in travel of the valve needle with respect to the valve seat occurs. As a result of this increase in travel of the valve needle, the travel damping component of the valve seat is reduced. With increasing temperature, the rate of through-flow of the fuel in comparison with the known valves therefore increases. Here, a 10 $\mu$m travel increase of the valve needle provides an increase in through-flow of approximately 2 to 4%. The reduction of the metered fuel by the formation of gas bubbles in the hot fuel in injection valves in which the valve seat carrier and valve needle are manufactured from the same material is reduced or partially compensated in the injection valve according to the present invention by the selection of different materials with coefficients of thermal expansion which differ greatly from one another.

It is particularly advantageous to achieve a further increase in travel by the use of a material with a larger coefficient of thermal expansion than that of chrome steel for the valve seat carrier. For this purpose, the valve seat carrier is formed from two valve seat carrier sections: the valve seat carrier section which is directed to one magnetic coil being produced, as already known, from a magnetic material, for example chrome steel, in order to ensure the magnetic flux in the magnetic circuit, and the valve seat carrier section which is directed towards a valve closing element consisting of brass or an aluminum alloy. These materials have coefficients of thermal expansion of $\alpha=18 \ldots 25\times10^{-6}$ $K^{-1}$. The repeated increase in travel of the valve needle by using two materials for the valve seat carrier permits a better compensation of the reduction in through-flow occurring as a result of the formation of gas bubbles.

DETAILED DESCRIPTION

Figure 1:
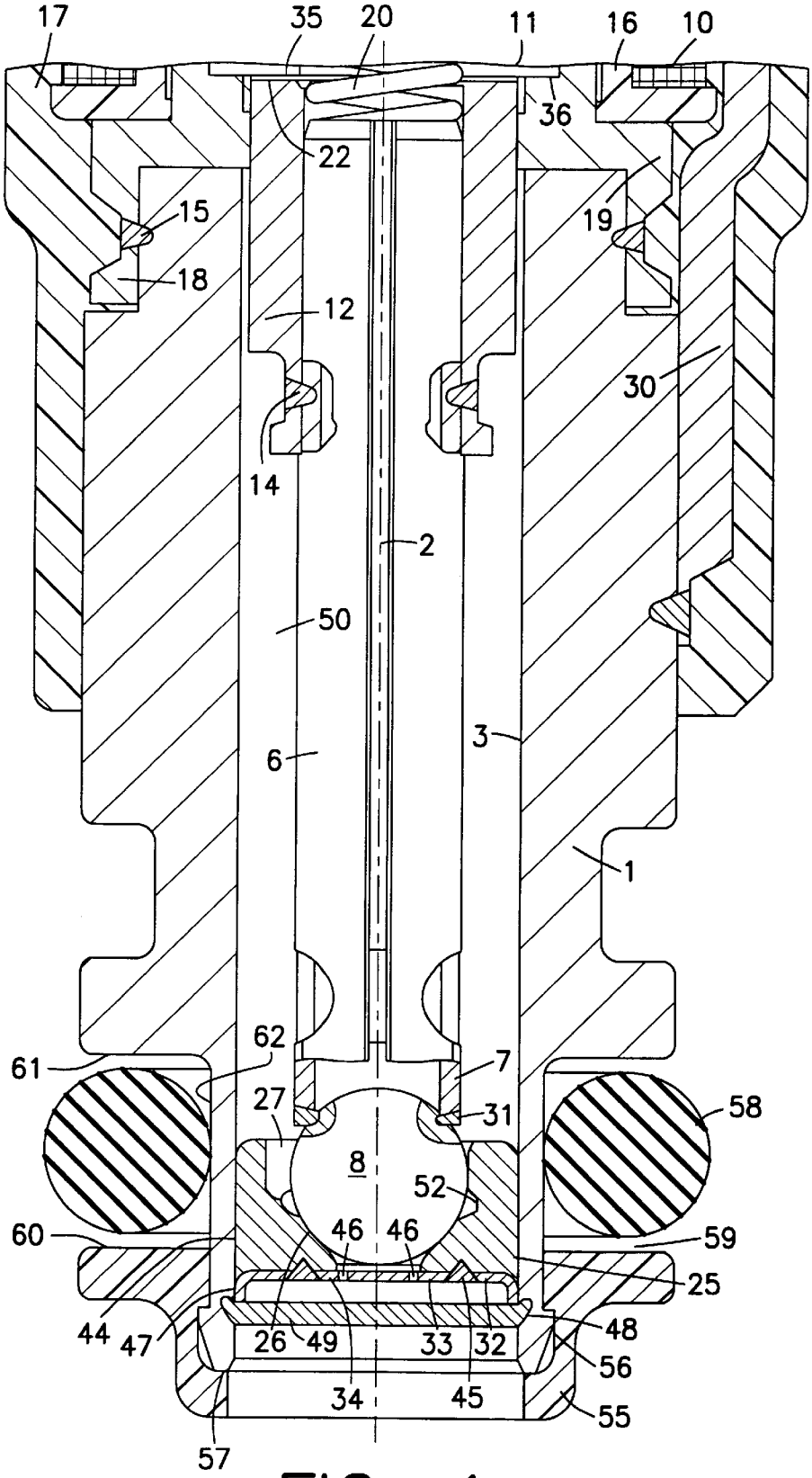
FIG. 1 is a partial view of a first exemplary embodiment of a fuel injection valve in accordance with the present invention.

In FIG. 1, a valve in the form of an injection valve for fuel injection systems of mixture-compressing, spark-ignition internal combustion engines is partially illustrated as a first exemplary embodiment. The injection valve has a tubular valve seat carrier 1 in which a longitudinal hole 3 is formed concentrically with respect to a longitudinal axis 2 of the valve. In the longitudinal hole 3, a tubular valve needle 6 is arranged which is connected at its downstream end 7 to an, e.g., spherical valve closing element 8.

The actuation of the injection valve takes place in a known manner, for example electromagnetically. An only partially illustrated electromagnetic circuit with a magnetic coil 10, a core 11 and an armature 12 serve for the axial movement of the valve needle 6 and thus for opening the injection valve counter to the spring force of a restoring spring 20 and closing it. The armature 12 is connected to the end of the valve needle 6 facing away from the valve closing element 8 by means of a first weld seam 14 and is directed towards the core 11. The magnetic coil 10 surrounds the core 11 which constitutes the end, surrounded by the magnetic coil 10, of a fuel inlet connector which serves to supply the medium, here fuel, which is to be metered by means of the valve. The magnetic coil 10 with a coil former 16 is provided with an injection molding encapsulation 17, with an electric connection plug (not illustrated) also being attached by injection molding at the same time.

A tubular, metal intermediate component 19 is connected, for example by welding, in a sealed fashion to the lower end of the core 11 concentrically with respect to the longitudinal axis 2 of the valve and at the same time engages partially axially over the end of the core 11. At its end facing away from the core 11, the intermediate component 19 is provided with a lower cylinder section 18 which engages over the tubular valve seat carrier 1 and is connected in a sealed fashion thereto, for example by means of a second weld seam 15. Furthermore, a lower end side 35 of the core 11, facing the armature 12, fits on a shoulder 36, leading to the upper cylinder section, of the intermediate component 19. A cylindrical valve seat element 25 is mounted in a sealed fashion, by welding, in the longitudinal hole 3, extending concentrically to the longitudinal axis 2 of the valve, in the downstream end of the valve seat carrier 1 facing away from the core 11. The valve seat element 25 has a fixed valve seat 26 facing the core 11.

The magnetic coil 10 is at least partially surrounded in the circumferential direction by at least one conductor element 30 which is constructed as a clip, serves as a ferromagnetic element and fits with its one end on the core 11 and with its other end on the valve seat carrier 1 and is connected thereto, e.g., by welding, soldering or a bonded connection. The plastic injection molded encapsulation 17 can serve to secure the at lease one guide element 30.

A guide opening 31 of the valve seat element 25 serves to guide the valve closing element 8 during the axial movement. The circumference of the valve closing element 25 has a slightly smaller diameter than the diameter of the longitudinal hole 3 of the valve seat element 1. At its one lower end side 32 facing away from the valve closing element 8, the valve seat element 25 is connected concentrically and permanently to a base component 33 of an injector nozzle disc 34 which is of, e.g., pot-shaped construction, so that the base part 33 fits with its upper end side 44 on the lower end side 32 of the valve seat element 25. The valve seat element 25 and injector nozzle disc 34 are connected for example by a circumferential and sealed third welding seam 45 which is constructed, e.g., by means of a laser. By means of this type of mounting the risk is avoided of undesired deformation of the base part 33 in the region of its at least one, for example four, ejection openings 46 which are formed by eroding or puncturing.

A circumferential securing edge 47 which extends facing away from the valve seat element 25 in the axial direction and is bent conically outwards up to its end 48 adjoins the base part 33 of the pot-shaped injector nozzle disc 34. The diameter of the securing edge 47 at its end 48 is larger here than the diameter of the longitudinal hole 3 in the valve seat carrier 1. Since the circumferential diameter of the valve seat element 25 is smaller than the diameter of the longitudinal hole 3 of the valve seat carrier 1, a radial pressing is present only between the longitudinal hole 3 and the conically outwardly bent holding edge 47 of the injector nozzle disc 34.

The insertion depth into the longitudinal hole 3 of the valve seat component consisting of valve seat element 25 and pot-shaped injector nozzle disc 34 determines the presetting of the travel of the valve needle since the one limit position of the valve needle 6 is fixed, when the magnetic coil 10 is not excited, by the valve closing element 8 resting on the surface of the valve seat 26 of the valve seat element 25. When the magnetic coil 10 is excited, the other limit position of the valve needle 6 is fixed for example by an upper end side 22 of the armature 12 resting on the lower end side 35 of the core 11. The path between these two limit positions of the valve needle 6 constitutes the travel.

At its end 48, the holding edge 47 of the injector nozzle disc 34 is connected to the wall of the longitudinal hole 3 by a circumferential and sealed fourth welding seam 49. The method of laser welding is possible for providing all the described welding seams 14, 15, 45, 49. Sealed welds are required so that the medium used, for example a fuel, cannot flow through between the longitudinal hole 3 of the valve seat carrier 1 and the circumference of the valve seat element 25 or the holding edge 47 of the injector nozzle disc 34 to the ejection openings 46 or into an intake line of the internal combustion engine.

The spherical valve closing element 8 interacts with the face of the valve seat of the valve seat element 25 which tapers in the shape of a truncated cone in the direction of flow and is constructed in the axial direction between the guide opening 31 and the lower end side 32 of the valve seat element 25. The guide opening 31 has at least one flow port 27 which permits the medium to flow from the interior 50 of the valve bounded in the radial direction by the longitudinal hole 3 to an annular groove 52 constructed in the direction of flow between guide opening 31 and valve seat 26 of the valve seat element 25, the said annular groove 52 being connected in the opened state of the valve to the ejection openings 46 in the injector nozzle disc 34.

A protective cap 55 is arranged on the circumference of the valve seat carrier 1 at its downstream end facing away from the magnetic coil 10 and is connected to the valve seat element 1 by means of a catch connection 56. The protective cap 55 fits both against one lower end side 57 of the valve seat carrier 1 and against the circumference of the valve seat carrier 1 above the catch connection 56. A sealing ring 58 is arranged in one annular groove 59 whose side faces are formed by an end side 60 of the protective cap 55, facing the magnetic coil 10, and by a radially upwardly pointing face 61 of the valve seat carrier 1. A base 62 of the groove 59 is formed by the circumference of the valve seat carrier 1. The sealing ring 58 serves to provide a seal between the circumference of the injection valve and a valve receptacle (not illustrated), for example the intake line of the internal combustion engine.

The pressing-in depth of an adjustment sleeve (not shown), which is pressed into the core 11 on the side of the restoring spring 20 facing away from the valve needle 6, determines the spring force of the restoring spring 20 and thus also influences the dynamic flow rate of the medium delivered during the opening and closing travel of the valve.

The valve according to the present invention is intended, by means of a suitable selection of materials with specific coefficients of thermal expansion, to contribute to the fact that when the valve heats up, increases in travel of the valve needle 6 and thus increases in the metered quantities of medium in comparison with the quantities of medium achieved with known injection valves with conventional material pairings are achieved.

Usually, the same material, for example chrome steel, is used for the valve seat carrier 1 and the valve needle 6. It is to be assumed that as the temperature of the fuel and of the internal combustion engine rises, the components of the valve also experience an increase in temperature. Since the valve seat carrier 1 and the valve needle 6 have previously been produced from the same material, these two valve components also have similar coefficients of thermal expansion; for chrome steel $\alpha$=approximately $16\times10^{-6}$ $K^{-1}$. As a result, during the heating of the valve, the changes in length of the valve seat carrier 1 and of the valve needle 6 are similar. Consequently, when the temperature of the valve increases, the travel of the valve needle 6 in the valve remains largely constant. This is disadvantageous because when the valve heats up a two-phase flow of fuel and bubbles of gas forms which leads to the metered fuel being reduced and thus the quantity of fuel ejected decreasing. Overall, when the materials for the valve seat carrier 1 and the valve needle 6 are the same, heating of the fuel and of the valve ensures a reduction in the delivered flow rate of the medium.

The selection, according to the present invention, of materials for the valve seat carrier 1 and the valve needle 6 has been made in order to reduce or compensate for this effect. In the first exemplary embodiment, which is illustrated in FIG. 1, chrome steel with a coefficient of thermal expansion $\alpha$=approximately $16\times10^{-6}$ $K^{-1}$ is used for the valve seat carrier 1. For the valve needle 6 a material with a very low coefficient of thermal expansion, such as for example invar steel where $\alpha$=0.9 . . . $1.5\times10^{-6}$ $K^{-1}$, is used. Invar steel is a material which is characterized by its particular nickel content. Therefore, even 36% Ni steel is possible. The material invar steel has a minimum thermal expansion and is therefore often used for measuring tools. As a result of the very low coefficient of thermal expansion of the material invar steel, which is used for the valve needle 6 the valve needle 6 expands less during heating in comparison with the valve seat carrier 1 consisting of chrome steel. As a result of this material pairing, when the fuel injection valve is heated there is an increase in travel for the valve needle 6 in comparison with the valve needle 26. As a result of the increase in travel, the travel damping component of the valve seat 26 is reduced. Thus, as the temperature rises the quantity of fuel flowing through the valve of the present invention increases in comparison to known valves. In the exemplary embodiment, a 10 $\mu$m increase in travel signifies an approximately 2 to 4% increase in through flow. Thus, the reduction of the quantity of the fuel flowing through caused by the formation of gas bubbles in the hot fuel, can be partially compensated.

Figure 2:
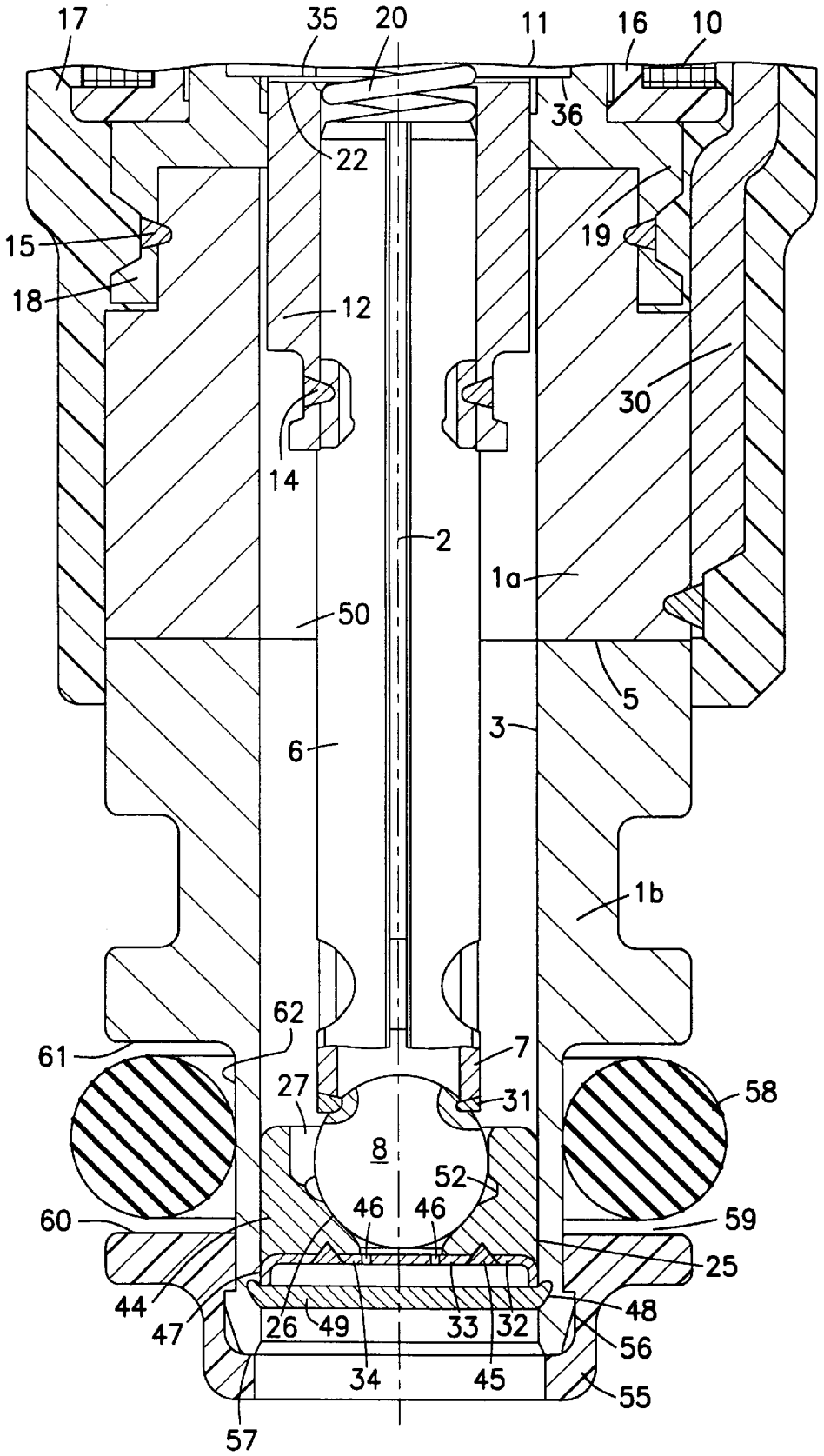
FIG. 2 is a partial view of a second exemplary embodiment of a fuel injection valve in accordance with the present invention.

In FIG. 2, in which components which remain the same or have the same function as in the exemplary embodiment illustrated in FIG. 1 are identified by the same reference symbols, a second exemplary embodiment for a valve in the form of an injection valve for fuel injection systems of spark-ignition internal combustion engines is partially illustrated. A further increase in travel, and thus an improvement in the compensation of the reduced through-flow quantity caused by the formation of gas bubbles in the hot fuel is achieved if, starting with a valve with a valve needle 6 consisting of invar steel, as shown in FIG. 2, the valve seat carrier 1 is formed from two valve seat carrier sections 1*a* and 1*b* which are produced from different materials and accordingly have different coefficients of thermal expansion, with at least one having a coefficient of thermal expansion larger than that of the valve needle 6. The valve seat carrier section 1*a*, which faces the magnetic coil 10, is produced, as in the first exemplary embodiment, from chrome steel with a coefficient of thermal expansion of $\alpha$=approximately $16\times10^{-6}$ $K^{-1}$ so that the magnetic flux in the magnetic circuit around the magnetic coil 10 remains closed between the armature 12 and the conductor element 30. The second valve seat carrier section 1*b*, adjoining in the direction of the valve closing element 8, is manufactured from a material with a larger coefficient of thermal expansion than that of the material for the valve seat carrier section 1*a*. Materials which can be used for this are, for example, brass or an aluminum alloy with coefficients of thermal expansion of $\alpha$=18 . . . $25\times10^{-6}$ $K^{-1}$. A sealed connection of the valve seat carrier sections 1*a* and 1*b* can be achieved, e.g., by hard soldering or resistance welding.

As a further variant of the use of material for the valve seat carrier 1 and the valve needle 6, it is conceivable, in contrast with the two preceding exemplary embodiments, to produce the valve needle 6 from, for example, chrome steel as is previously known. In order, even in this embodiment, to achieve an increase in travel for the valve needle 6 in comparison with the previously known material pairings in injection valves, at least one valve seat carrier section 1*a*, 1*b* must be manufactured from a material with a larger coefficient of thermal expansion than that of chrome steel ($\alpha$=approximately $16\times10^{-6}$ $K^{-1}$), for example, from brass or an aluminum alloy with a coefficient of thermal expansion of $\alpha$=18 . . . $25\times10^{-6}$ $K^{-1}$.

What is claimed is:

1. An electromagnetically actuated valve comprising:

a core surrounded by a magnetic coil;

a valve seat;

an armature for actuating a valve closing element, the valve closing element interacting with the valve seat and being attached to a valve needle comprised of invar steel;

a valve seat carrier which receives the valve seat and into which the valve needle projects, wherein the valve seat carrier is comprised of chrome steel;

wherein the valve seat carrier is comprised of a material with a larger coefficient of thermal expansion than a coefficient of thermal expansion of the valve needle.

* * * * *